United States Patent [19]

Eberle

[11] Patent Number: 4,982,944

[45] Date of Patent: Jan. 8, 1991

[54] TRANSPORT APPARATUS FOR TRANSPORTING CONTINUOUSLY ARRIVING FLAT PRODUCTS, ESPECIALLY PRINTED PRODUCTS

[75] Inventor: Jürg Eberle, Hinwil, Switzerland

[73] Assignee: Ferag AG, Hinwil, Switzerland

[21] Appl. No.: 259,839

[22] Filed: Oct. 19, 1988

[30] Foreign Application Priority Data

Oct. 23, 1987 [CH] Switzerland ..... 4158/87

[51] Int. Cl.[5] ..... B65H 29/04

[52] U.S. Cl. ..... 271/204; 271/82; 271/277; 198/803.9; 101/408; 294/99.1; 294/103.1; 294/902

[58] Field of Search ..... 271/277, 204, 205, 206, 271/82; 101/408, 409, 410; 198/803.7, 803.9; 294/103.1, 99.1, 902

[56] References Cited

U.S. PATENT DOCUMENTS

| | | | |
|---|---|---|---|
| 3,671,035 | 6/1972 | Reist | 271/202 |
| 3,955,667 | 5/1976 | Muller et al. | 271/204 X |
| 4,381,056 | 4/1983 | Eberle | 271/204 X |
| 4,448,408 | 5/1984 | Faltin | 271/204 X |
| 4,512,457 | 4/1985 | Reist et al. | 271/277 X |
| 4,799,664 | 12/1989 | Burger . | |
| 4,893,805 | 1/1990 | Eberle | 271/204 |

FOREIGN PATENT DOCUMENTS

| | | | |
|---|---|---|---|
| 3710249 | 1/1988 | Fed. Rep. of Germany | 101/409 |

*Primary Examiner*—H. Grant Skaggs
*Assistant Examiner*—Boris Milef
*Attorney, Agent, or Firm*—Bell, Seltzer, Park & Gibson

[57] ABSTRACT

Individually controllable gripper elements are successively spacedly arranged at a ball-and-socket joint-link chain revolvingly driven and guided in a guide channel. At the leading end region of an overhang member of each gripper element there is seated a clamping jaw and at the trailing end region there is arranged a bushing. A shaft is rotatably and displaceably mounted within the bushing. A clamping finger, coactable with the clamping jaw, is rigidly connected with the upper shaft end. At the lower shaft end there is seated a slide shoe and the lower end region of the shaft is encircled by a pivotable element rotatably connected with the shaft. A compression spring rigidly bears for rotation at the pivotable element and the overhang member. When the slide shoe travels onto a stationary cam the clamping finger is raised against the force of the compression spring. An actuation element, which acts upon a further slide shoe, rotates the clamping finger through an angle of about 90°. In this position the slide shoe at the lower end of the shaft travels off the stationary cam, resulting in the clamping finger bearing upon the clamping jaw. Since the compression spring is pre-biased in the direction of the open position of the clamping finger the latter can pivot back into the open position by slightly raising the slide shoe at the lower end of the shaft.

10 Claims, 4 Drawing Sheets

TRANSPORT APPARATUS FOR TRANSPORTING CONTINUOUSLY ARRIVING FLAT PRODUCTS, ESPECIALLY PRINTED PRODUCTS

CROSS-REFERENCE TO RELATED APPLICATION

This application is related to the commonly assigned, co-pending U.S. application Ser. No. 07/234,731, filed Aug. 22, 1988, now U.S. Pat. No. 4,893,805, and entitled "TRANSPORT APPARATUS FOR PRINTED PRODUCTS AND USE OF SUCH TRANSPORT APPARATUS".

BACKGROUND OF THE INVENTION

The present invention generally relates to material transport apparatuses and, more specifically, pertains to a new and improved construction of a transport apparatus for the transport or conveyance of substantially flat structures products or articles, in particular continuously arriving printed products.

Generally speaking, the transport apparatus of the present development is of the type comprising a plurality of individually controllable gripper elements or grippers which are arranged in mutually spaced relationship in tandem or succession at a traction element which is revolvingly driven in a predetermined direction of transport or conveyance of the products. Each of the gripper elements or grippers comprises a clamping jaw and a clamping finger for engaging one of the edges of the continuously arriving flat structures, products or articles, especially printed products. The products generally are of the type which continuously arrive in an imbricated or shingled formation and the edges which are engaged or grasped by the gripper elements or grippers extend transversely with respect to the predetermined direction of transport or conveyance of the products.

Furthermore, each clamping finger extends essentially at right angles or orthogonally from a shaft or shaft member and can be selectively pivoted back and forth from an open gripper position where the clamping finger is directed transverse to the product conveying direction into a closed gripper position in which the clamping finger is directed in the product transport or conveyance or conveying direction. A closing or closure spring or spring member biases the clamping finger towards the clamping jaw.

A transport apparatus of the aforementioned general type is known from Swiss Pat. No. 468,923, granted Feb. 28, 1969 and the cognate U.S. Pat. No. 3,671,035, granted June 20, 1972. A threaded bushing arranged at an overhang or cantilever arm is provided with a female thread of large pitch. A shaft or shank is threaded into the female thread and a clamping finger protrudes at right angles from the shaft or shank. At the end region of the shaft, situated remote from the clamping finger, there is provided a laterally protruding slide shoe or at its end a slide shoe which is effective in axial direction of the shaft. A closing spring arranged about the shaft and the threaded bushing or sleeve bears at one end at the overhang or cantilever arm and at the other end at the associated slide shoe. When the laterally protruding slide shoe travels onto a stationary cam then the shaft is rotated.

Due to such shaft rotation and as a consequence of the provision of the thread or threading there also results lifting of the clamping finger from the clamping jaw. On the other hand, if the slide shoe travels onto a stationary actuation element, for instance a roll track, then the clamping finger is raised from the clamping jaw and due to the presence of the threading there results a pivoting or rocking of the clamping finger out of the closed position into the open position. Upon travel of the corresponding slide shoe off of the cam or the actuation element the shaft, under the action of the closing spring, moves towards the clamping jaw. This, in turn, results in a pivoting of the clamping finger into the closed position owing to the presence of the threading or thread. The angle of turning or rotation of the clamping finger and the shaft is dependent upon the thickness of the printed product which is to be fixedly held or retained. In order to positively retain printed products of different thicknesses, it is necessary that the free end of the clamping finger which is located remote from the shaft be designed to be quite wide. This in turn, requires a relatively large angle of rotation or turning of the clamping finger. Additionally, there exists the problem that the thread in the threaded bushing or sleeve and at the shaft must be exactly aligned with respect to the clamping finger. Such requires relatively complicated fabrication operations.

Moreover, if a gripper or gripper element is to be arranged at both sides of the traction element, then there must be employed threaded bushings or sleeves having both right-hand thread and left-hand thread, resulting in an increase in the number of different individual parts or components which must be provided for the construction of the transport apparatus.

SUMMARY OF THE INVENTION

Therefore with the foregoing in mind it is a primary object of the present invention to provide a new and improved construction of transport apparatus of the aforementioned general type which does not suffer from the aforementioned drawbacks and shortcomings of the prior art.

Another important object of the present invention aims at simplifying the construction of the prior art transport apparatus previously discussed.

Yet a further noteworthy object of the present invention is directed to a new and improved construction of transport apparatus for the transport or conveyance of continuously arriving substantially flat structures, especially printed products, in an extremely efficient, reliable and protective fashion.

Still another significant object of the present invention is directed to a new and improved construction of a transport apparatus for the transport or conveyance of continuously arriving substantially flat structures, especially printed products, which transport apparatus is relatively simple in construction and design, quite economical to manufacture, exceedingly reliable in operation, not readily subject to breakdown and malfunction, and requires a minimum of maintenance and servicing.

A further appreciable object of the present invention is directed to an improved construction of transport apparatus for substantially flat products, especially continuously arriving printed products, wherein there are provided gripper elements which are constructed in such a fashion that they reliably grip in a safe and protective fashion the handled products, without appreciable danger of damage to the gripped or seized products, and further more, opening and closing of the gripper elements can be accomplished in an exceedingly reliable manner.

Now in order to implement these and still further objects of the invention, which will become more readily apparent as the description proceeds, the transport apparatus of the present development, among other things, is manifested by the features that the clamping finger of each gripper element is additionally resiliently pre-biased into the open position of the gripper element, and the force of the closing spring is greater than the pre-biasing force in the closed position of the gripper element.

By virtue of the construction of the transport apparatus according to the present invention, it is unnecessary to employ a threaded bushing or sleeve and threading at the shaft or shaft member. Additionally, the angle of rotation of the clamping finger of each gripper element is independent of the thickness of the printed products. Retention of the clamping finger in the closed position of the related gripper element or gripper is ensured by virtue of the larger force of the closing or closure spring in relation to the pre-biasing force thereof.

In order to devise a particularly simple construction of transport apparatus the pre-biasing force is generated by the closing or closure spring itself.

According to a further embodiment of the invention, there is seated upon the shaft at an end region thereof remote from the associated clamping finger a displacement element, for instance in the form of a slide shoe which protrudes laterally from the shaft in the open position of the related gripper element. This slide shoe is intended to coact with a stationary actuation element, for instance a cam or cam member, in order to pivot or displace the associated clamping finger or finger member into the closed position. Since during the pivoting or turning of the clamping finger into the closed position thereof, the pre-biasing force of the closing spring is increased, there is not required any further actuation element or the like for the transfer of the clamping finger back into its open position. The pivotal or rocking motion of the clamping finger is not coupled with the movement thereof in axial direction of the shaft.

According to a further preferred exemplary embodiment of the transport apparatus, the end of the shaft which is remote from the associated clamping finger or finger member is provided with a further displacement element, for instance a further slide shoe which is intended to travel onto a stationary cam or cam member. This stationary cam lifts the shaft out of the closed position of the clamping finger of the related gripper element against the action of the closing or closure spring. As a result, the clamping finger is automatically and relatively suddenly pivoted back into the open position thereof.

According to a further advantageous construction of the invention, the clamping jaw preferably is equipped with a profile element covered by a friction-promoting or friction-increasing covering or liner. This profile element is mounted to be pivotable to a limited extent at the associated overhang or cantilever member about a pivot axis which is directed in the product transport or conveyance direction and, specifically, approximately parallel to such product transport or conveyance direction. With this design there is ensured, in any event, not merely point-shaped or point-like contact of the flat structure or product at the associated clamping jaw or jaw member. Additionally, there is precluded any damage or mutilation to the printed product.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the transport apparatus has been illustrated therein as is needed to enable one skilled in the art to readily understand the underlying principles and concepts of this invention.

Figure 1:
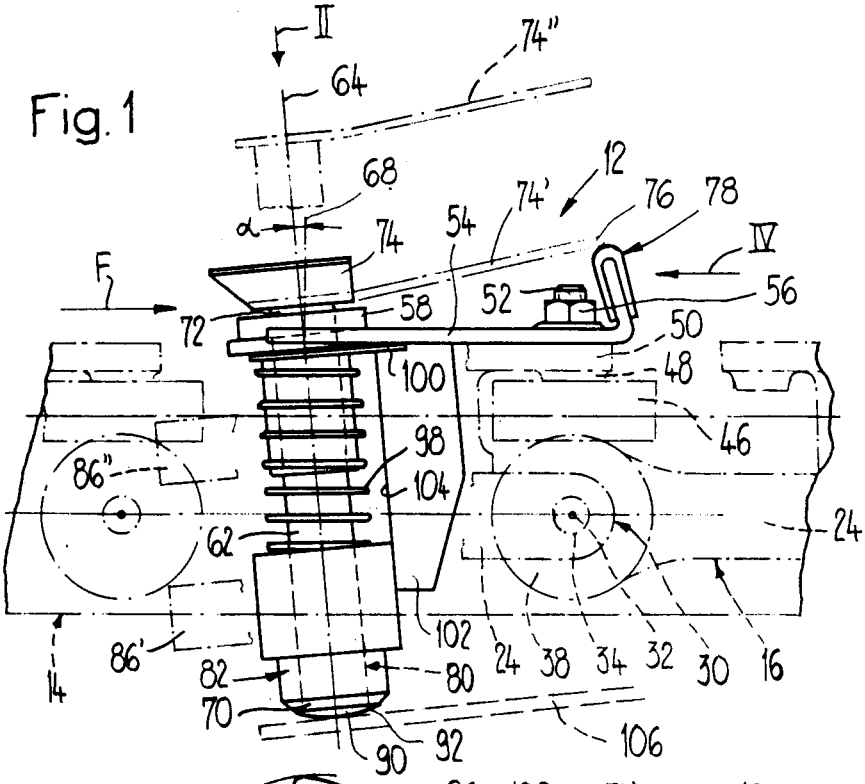
FIG. 1 illustrates in fragmentary side view a portion of the transport apparatus and depicting a part of the traction element with one of the gripper elements or grippers arranged thereat.
Figure 2:
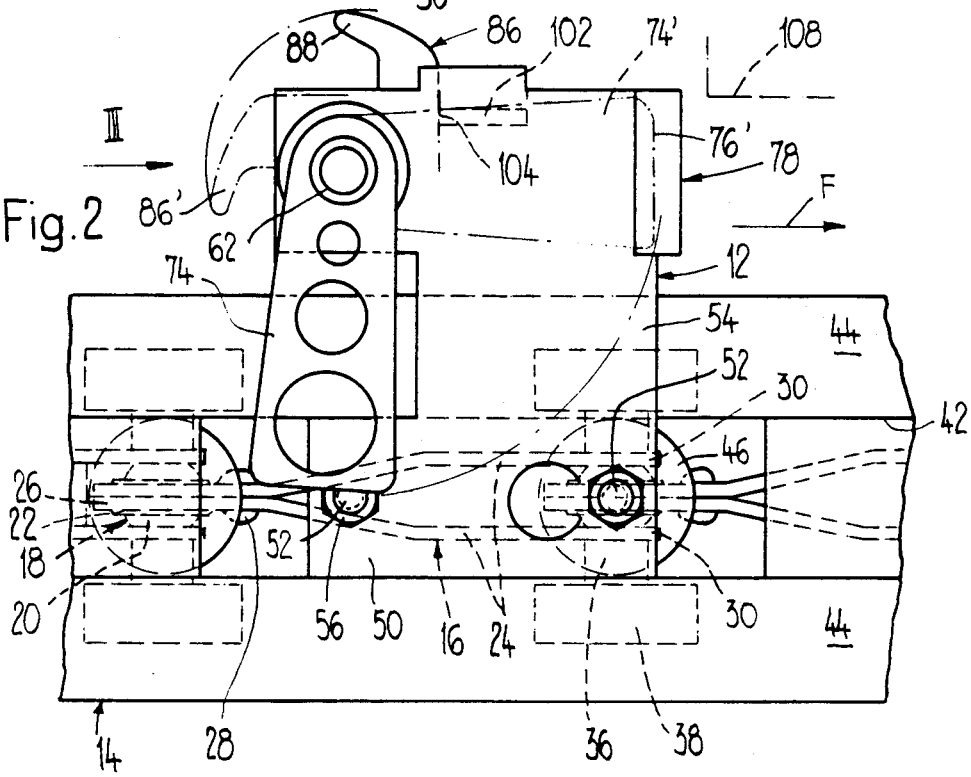
FIG. 2 is a top plan view of the arrangement of FIG. 1, again depicting a part of the traction element with one of the gripper elements arranged thereat.
Figure 3:
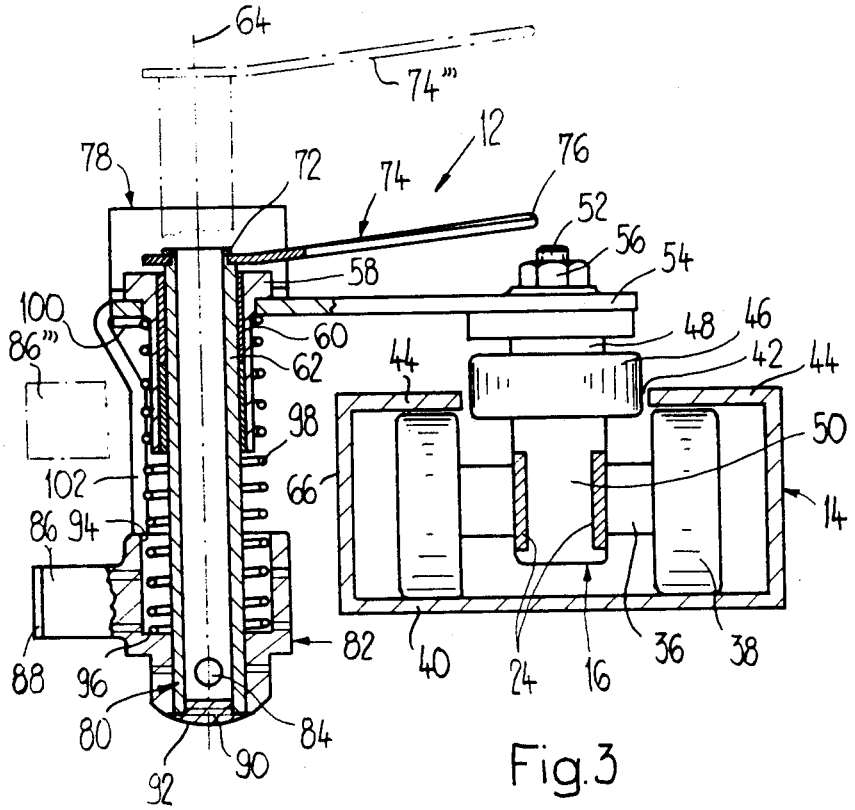
FIG. 3 illustrates in side view and partially in sectional view, looking generally in the direction of the arrow III of FIG. 2, details of the traction element and the associated gripper element.

Based upon the illustration of FIGS. 1 to 3 there initially will be described in greater detail the traction or towing element, here shown in the form of a link chain 16, and one of the gripper elements or grippers 12 arranged at such traction element. It is to be understood that since a plurality of such gripper elements 12 are arranged at the traction element it will suffice to describe in detail the construction and arrangement of one such gripper element 12 since the other gripper elements 12 are similarly constructed and arranged at the traction element. Continuing, it will be observed that in a substantially C-shaped guide channel or channel member 14 (see FIG. 3) there is displaceably guided the traction element, specifically here constructed as a ball-and-socket joint-link chain or chain member 16 which is revolvingly driven, as will be explained at a later point, so as to move in a predetermined product transport or conveying direction F. In the showing of FIG. 1, the guide channel 14 as well as the ball-and-socket joint-link chain 16 have been depicted in phantom or chain-dot lines, and the gripper element 12 has been shown in full or solid lines. In FIGS. 2 and 3 the guide channel 14, the ball-and-socket joint-link chain 16 and the gripper element 12 have been depicted in full or solid lines.

As best seen by referring to FIG. 2, each ball-and-socket joint 18 of the link chain or chain member 16 comprises a substantially spherical-shaped flattened joint or hinge body or body member 20 which is equatorially encircled by a substantially ring-shaped joint or hinge socket or socket member 22. Each ball-and-socket joint 18 is connected with the neighboring ball-and-socket joint 18 by means of two respective flexed chain brackets or links 240. At their one end regions or portions 26 these chain links or link members 24 bear against one another and are interconnected by means of suitable attachment elements, such as rivets 28 or equivalent structure. The joint socket or socket member 22 is enclosed by not particularly referenced recesses or openings of the end regions or portions 26 of the chain links 24. The oppositely situated end regions or portions 30 of the chain links 24 form a forked or bifurcated structure in which there is accommodated the flattened joint or hinge body or body member 20. As best seen by referring to FIG. 1, this joint or hinge body 20 is pierced by a shaft or axle 32 which extends through openings 34 of the end regions or portions 30 of the chain links 24 and carries laterally of the chain links 24 spacer or distance sleeves or sleeve members 36 as well as travel wheels or rolls 38 or equivalent travel structure.

As will be particularly well seen by inspecting FIG. 3, these travel wheels or rolls 38 move upon the base or floor 40 as well as along the flanks or flank portions 44 of the substantially C-shaped guide channel or channel member 14. These flank portions of the substantially C-shaped guide channel 14 are spaced from one another to form therebetween a gap or space 42.

Now between the spaced flanks or flank portions 44 of the substantially C-shaped guide channel 14 there is arranged a guide wheel or roll 46, the not particularly substantially at right angles or orthogonally with respect to the chain links or brackets 24 and is aligned approximately with the central region of the joint or hinge body 20. As will be particularly understood by referring to FIGS. 1 and 3, a rotational or rotary shaft or shaft member 48 of the guide wheel or roll 46 is retained at the one end of a flexed or bent support or carrier member 50 which engages at its other end between the end regions or portions 30 of the chain links 24 and is connected therewith. Such type of ball-and-socket joint-link chain 16 is well known in the art from the German Published Patent Application No. 2,629,528 and the essentially cognate U.S. Pat. No. 4,294,345, granted Oct. 13, 1981, to which reference may be readily had and the disclosure of which is incorporated herein by reference.

As will be recognized from FIG. 2, two threaded bolts or bolt members 52 are arranged at the support or carrier member 50. An overhang or cantilever member 54, here shown in the form of an overhang or cantilever arm of the related gripper element 12, is secured by means of nut members 56 at these two threaded bolts 52. The cantilever or overhang member 54 may be, for instance, formed of sheet metal or metal plating. An open-ended bushing or sleeve member 58 is provided laterally of the guide channel 14 at the overhang or cantilever member 54. This open-ended hollow bushing 58 is provided therein with a guide sleeve or sleeve member 60. A hollow substantially cylindrical shaft or shaft member 62 is displaceably and rotatably guided within this guide sleeve or sleeve member 60. The axis of rotation 64 of the shaft 62 extends in a plane which is disposed substantially parallel to side walls 66 of the guide channel 14, as best recognized by inspecting FIG. 3. This axis of rotation 64 of the shaft 62 is arranged at an inclination in relation to a normal or perpendicular 68 with respect to the base or floor 40 of the guide channel 14, and specifically at an acute angle $\alpha$ (see FIG. 1) such that the lower end or end portion 50 of the shaft 62 leads with respect to the upper shaft end 72 as viewed in relation to the product transport or conveying direction F.

Furthermore, it will be observed from the illustration of FIGS. 1 to 3 of the drawings, that at the upper shaft end or end region 72 there is rigidly connected for rotation with the shaft 62 a clamping finger or finger member 74 of the related gripper element 12. The free end 76 of this clamping finger 74 protrudes slightly upwardly or in ascending fashion in relation to a plane which is disposed substantially at right angles to the axis of rotation 64 of the shaft 62. In FIGS. 1 to 3 the clamping finger 74 has been depicted in its open position with full or solid lines and in which it extends transversely with respect to the product transport or conveying direction F, whereas in the closed position of such clamping finger 74, and as depicted in phantom or chain-dot lines and designated by reference character 74' in FIG. 1, such clamping finger 74 extends substantially parallel to or in the product transport or conveying direction F. In FIG. 1 there also has been shown in likewise phantom or chain-dot portrayal, as indicated by reference character 74", the clamping finger 74 in its closed position but raised from the associated clamping jaw or jaw member 78. In FIG. 3 the chain-dot depicted position 74''' of the clamping finger 74 shows the latter in its open position, however displaced upwardly.

At the lower end region 80 of the rotatable shaft 62 there is seated a pivotable or pivotal element 82 which is rigidly connected for rotation by means of a suitable connection element, here in the form of a pin 84 with the shaft 62. Extending outwardly from the pivotable element 82, with the clamping finger 74 in its open position (see FIG. 2), is a suitable displacement element here shown in the form of a slide shoe or shoe member 86. The free or protruding end 88 of this slide shoe or shoe member 86, as viewed in the product transport or conveying direction F, is rearwardly flexed or bent as will be seen by referring to FIGS. 2 and 3. In FIG. 1 reference characters 86' and 86" depict the slide shoe 86 in the closed position of the related clamping finger 74, wherein the position designated by reference character 86' represents that position of the slide shoe 86 which is associated with the afore-explained position 74' of the clamping finger 74 and reference character 86' represents that position of the slide shoe 86 associated with the afore-explained position 74" of the clamping finger 74. In FIG. 2 reference character 86' designates the position of the slide shoe 86 in the closed position 74' of the clamping finger 74, and in FIG. 3 reference character 86''' designates that position of the slide shoe 86 in the open position corresponding to the position of the clamping finger 74 when it assumes the position 74'''. The lower end 70 of the shaft 62 is provided with a further displacement element, here in the form of a slide shoe or shoe member 90. The outer surface 92 of this further slide shoe 90 possesses a substantially segmented spherical configuration.

As will be observed by referring to FIG. 3, within a coaxial recess or pocket 94 of the pivotable element 82 there is rigidly supported for rotation the lower end or end portion 96 of a compression or pressure spring 98 or equivalent force-exerting structure which is arranged about the shaft 62 and the bushing 58. The upper end 100 of this compression spring 98 bears against the overhang or cantilever member 54 and tangentially bears against a downwardly flexed tongue or tongue member 102 of such overhang or cantilever member 54. In the open position of the gripper finger 74 the laterally protruding slide shoe 86 comes to bear at an edge or edge portion 104 of the tongue member 102 and which edge portion trails as viewed in the product transport or conveying direction F.

In FIG. 1 there has been illustrated in phantom or chain-dot lines an actuation element or actuator in the form of a stationary cam or cam member 106 which coacts with the slide shoe or shoe member 90 and in FIG. 2 there has been depicted an actuation element or actuator 108 onto which travels the other laterally protruding or radially extending slide shoe 86. The cam or cam member 106 is arranged in a plane disposed approximately perpendicular to the axis of rotation 64 of the shaft 62 and viewed in the product conveying direction F extends at an inclination upwardly or in ascending ramp-like fashion as shown in FIG. 1.

Figure 4:
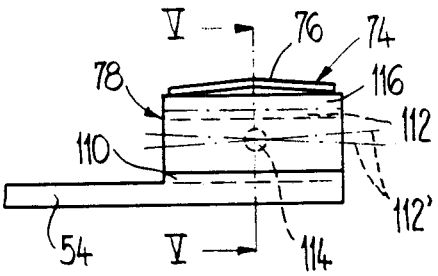
FIG. 4 is an enlarged front view of one of the gripper elements depicting details of the clamping jaw and related clamping finger as seen when looking generally in the direction of the arrow IV of FIG. 1.
Figure 5:
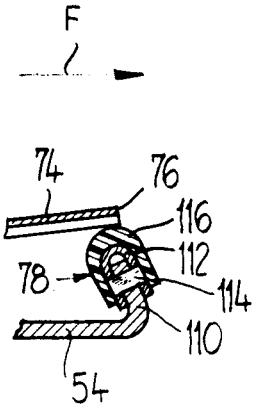
FIG. 5 is a cross-sectional view of the arrangement of FIG. 4, the section being taken substantially along the line V—V of FIG. 4.

In FIG. 4 there has been depicted in greater detail a variant construction of the clamping jaw 78 as viewed when generally looking in the direction of the arrow IV of FIG. 1. FIG. 5 illustrates a sectional view of the clamping jaw 78 of the related gripper element 12, taken substantially along the line V—V of FIG. 4 and also depicts in section the clamping finger or finger member 74 which bears against the clamping jaw 78 or at a gripped product, as the case may be. At the region of this clamping jaw 78 there is provided a further tongue or tongue member 110 of the overhang or cantilever member 54 which extends upwardly and, again viewed in the product conveying direction F, is flexed so as to ascend slightly towards the rear. The free end of the tongue or tongue member 110 is covered by a substantially U-shaped profile element or piece 112. This profile element 112 is mounted for limited pivotable movement at the tongue or tongue member 110 by means of a pivot pin 114 or equivalent structure which extends through the central region thereof, and wherein the lengthwise axis of the pivot pin 114 extends in the product conveying direction F and preferably approximately parallel to such product conveying direction F.

The pivotal or pivot range of the profile element 112 has been depicted in chain-dot lines in FIG. 4 and designated by reference character 112'. This profile element 112 is advantageously covered with a friction-promoting or increasing cover or lining 116, for instance formed of rubber or elastomeric material. The pivotable clamping finger or finger member 74 bears in its closed position upon this cover or lining 116. The end region 76 of such clamping finger 74 is here designed so as to have a substantially roof-shaped or peaked configuration, in other words is concave in relation to the clamping jaw 78 and can be roughened or suitably profiled or structured. As a result, the clamping finger 74 always comes to bear at least at two points or locations at the clamping jaw 78, and even then when the axis of rotation 64 of the shaft 62 and the lengthwise axis of the pivot pin 114 are not at right angles to one another or, for whatever reason, the clamping finger 74 has not been completely pivoted or rocked into its closed position 74'.

Based upon the illustration of FIGS. 1 to 3, there now will be described in greater detail the operation of one of the gripper elements or grippers 12 which, as will be understood, is typical for all other ones of these gripper elements or grippers 12. Before the slide shoe 90 travels, while moving in the product conveying direction F, upon the cam or cam member 106, the clamping finger 74 of such gripper element 12, owing to the closing force applied by the compression or pressure spring 98 and its pre-bias about the lengthwise axis 64 of the shaft 62 in the clockwise direction of FIG. 2, is located in the open position as indicated for the gripper finger 74 shown in solid lines in such FIG. 2. This open position of the clamping finger 74 is defined by contact of the slide shoe 86 at the trailing or rear edge 104 of the associated tongue member 102. By virtue of the subsequent travel of the slide shoe or shoe member 90 upon the cam member 106 the clamping finger 74 is raised against the force of the compression or pressure spring 98 into the position depicted by reference character 74''' in FIG. 3, and the slide shoe 86 slides along the trailing or rear edge 104 so as to assume the position indicated by reference character 86''' in FIG. 3.

Now as soon as the clamping finger 74 has reached the clamping finger position indicated by reference character 74''', then the cam member 106 extends substantially parallel to the base or floor 40 of the guide channel 14 and the laterally extending slide shoe 86 travels upon the actuation element 108 (see also FIG. 2). As a result, the clamping finger 74 is pivoted or rocked in counter-clockwise direction into the clamping finger position indicated by reference character 74'' in FIG. 1. From that point on, the cam member 106 extends at a downward inclination or in descending fashion in the product conveying direction F so that the clamping finger 74 is lowered into the closed position indicated by reference character 74' and the free end 76 of this clamping finger 74 comes to bear upon the fixed clamping jaw 78, as best recognized by referring to FIGS. 1 and 2. As soon as this condition has been attained, the actuation element 108 can release the slide shoe 86. It is to be expressly understood, however, that since the force of the compression or pressure spring 98 is greater than the pre-biasing or urging force in the opening direction of the clamping finger 74 this clamping finger 74 remains in its closed position as indicated by reference character 74' in FIG. 1 and shown in phantom or chain-dot lines.

Figure 6:
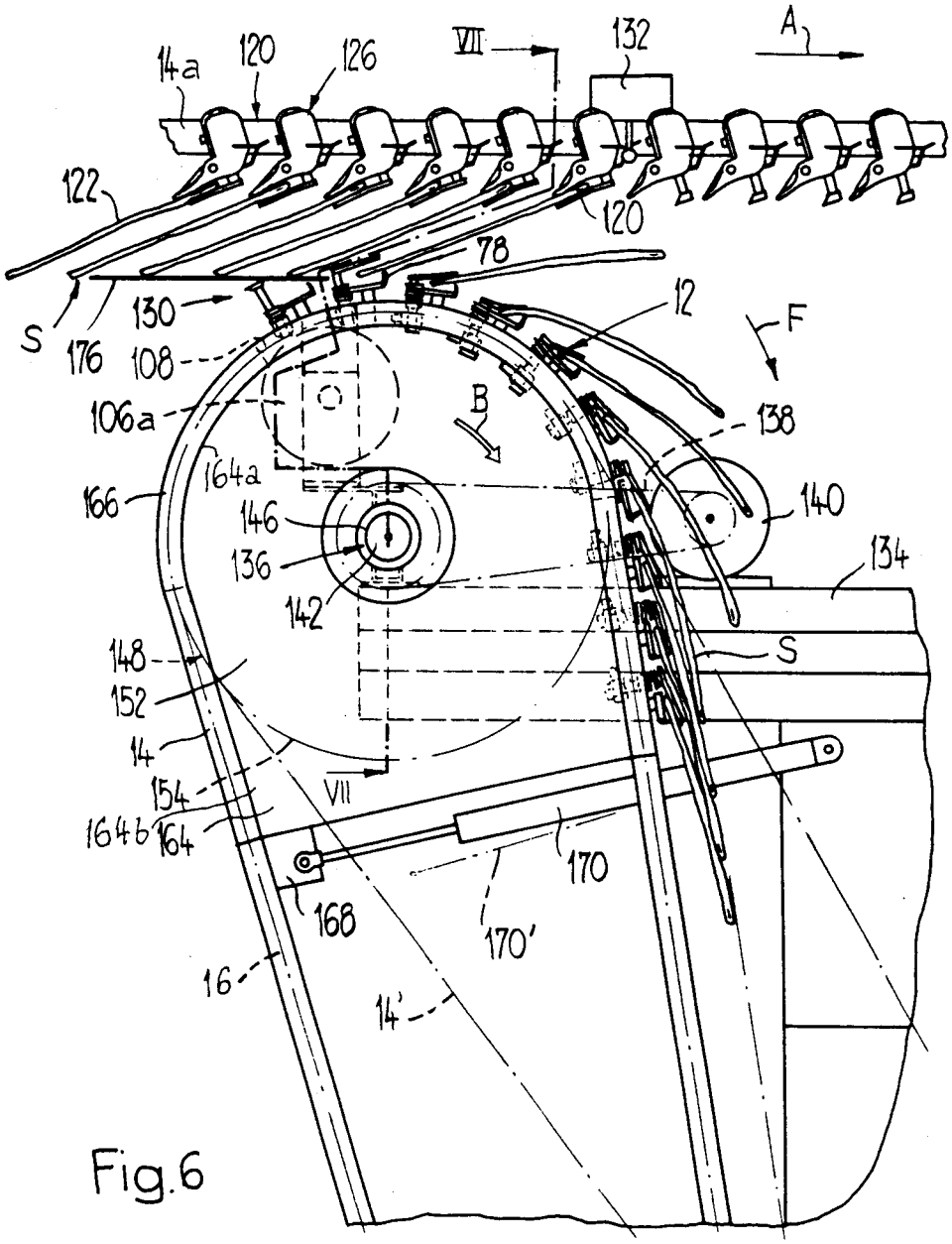
FIG. 6 illustrates in fragmentary view details of the transport apparatus of the present development equipped with a number of gripper elements or grippers arranged at the related traction element, the gripper elements or grippers taking over printed products of an arriving imbricated stream of such printed products and outfeeding such engaged printed products.
Figure 7:
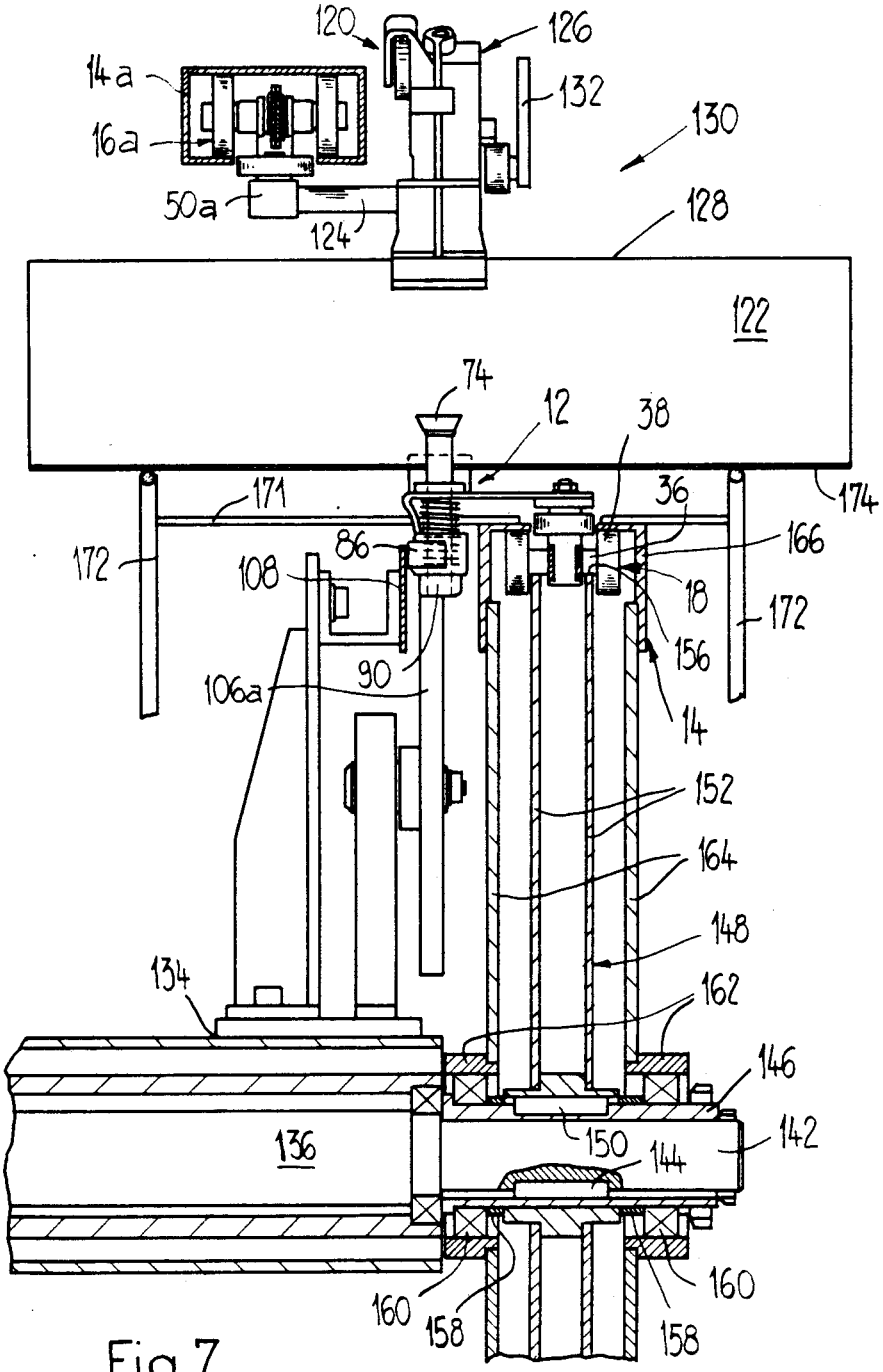
FIG. 7 illustrates in sectional view details of the transport apparatus depicted in FIG. 6, the section being taken substantially along the line VII—VII thereof.

In FIGS. 6 and 7 there has been depicted a transport apparatus or arrangement equipped with a plurality of individual controllable gripper elements or grippers 12 of the construction and mode of operation as previously described. These individually controllable gripper elements 12 are arranged in succession or tandem at a fixed mutual spacing or pitch from one another at the revolvingly driven ball-and-socket joint-link chain or chain member 16 which is guided for revolving motion in the associated guide channel 14 as likewise previously explained. The gripper elements 12 take over the infed flat structures or articles, here printed products 122, such as newspapers, magazines, periodicals or sections or components thereof and further transport such engaged or seized printed products 122. These printed products 122 are delivered in an imbricated or shingled formation S by a product infeed conveyor 120 or the like. In FIG. 6 the ball-and-socket joint-link chain 16 has been depicted in phantom or chain-dot lines.

The product infeed conveyor 120 likewise contains a ball-and-socket joint-link chain 16a guided in an associated guide channel 14a, and such link chain 16a may be of the same construction as described previously and used in the heretofore explained construction of transport apparatus. Furthermore, it will be observed that rod members or rods 124 extend from support or carrier members 50a in a direction transverse to the product conveying direction A of the product infeed conveyor 120. At these rods 124 there are arranged gripper elements or grippers 126 which, for instance, advantageously can possess a gripper construction as such is known from the German Pat. No. 2,519,561 and the cognate U.S. Pat. No. 3,955,667, granted May 11, 1976, reference being made in particular to FIG. 7 thereof. The disclosure of such patent documentation is accordingly incorporated herein by reference. These conventional gripper elements 126 release the printer products 122 which are grasped at their leading product edges 128 (FIG. 7) at a product transfer region 130 owing to the action of an associated control, here shown as an elevation or lift device 132 or equivalent control structure, as is well known in this technology.

Continuing, a drive shaft or shaft member 136 is rotatably mounted at a frame or frame member 134. This drive shaft 136 is operatively connected by means of the phantom-line depicted chain drive 138 with a suitable drive motor or drive means 140 arranged at the frame 134. A cam wheel or roll 106a is freely rotatably mounted likewise at the frame 134 at the product transfer region 130. This rotatable cam wheel 106a acts at the product transfer region 130 upon the slide shoes 90 of the gripper elements 12 which are moving therepast. Also the actuation element 108 which acts at the product transfer region 130 upon the other slide shoes 86 of the gripper elements 12 is stationarily arranged at the frame 134.

A bearing sleeve or sleeve member 146 is seated at the one shaft end 142 of the drive shaft 136 and is secured for rotation therewith by means of a key 144 or equivalent fixation element. A drive wheel 148 is seated at its axial central region upon the bearing sleeve 146. This drive wheel or wheel member 148 is likewise rigidly connected for rotation by means of a key 150 or equivalent fixation element with the bearing sleeve or sleeve member 146. This drive wheel 148 possesses two substantially parallel drive plates or plate members 152. At the coaxial outer edges 154 of these drive plates 152 there are provided recesses or pockets 156. These recesses or pockets 156 are spaced from one another at the spacing of the axles or axes 32 of the ball-and-socket joint-link chain 16. The spacer sleeves 36 of the link chain 16 come into engagement with the recesses or pockets 156 (see also FIG. 3). The drive wheel 148 is appropriately driven so as to rotate in the direction of the arrow B which, in turn, dictates the product conveying or transport direction F.

Ball bearings 160 or equivalent bearing structure are arranged upon the bearing sleeve 146 at each side of the drive wheel 148 and are spaced from the drive wheel 148 by means of the spacer or distance sleeves or sleeve members 158. Each ball bearing 160 is encircled by a ring or ring member 162. Each ring member 162 carries an associated guide plate or plate member 164. Approximately that half of each guide plate 164 which is directed towards the product infeed conveyor 120 is coaxially curved at its marginal portion or region 164a with respect to the drive shaft 136, whereas the lateral linear edges 164b of the other half of each guide plate 164 extend approximately tangentially, as best seen by referring to FIG. 6. Substantially L-shaped guide profiles or section members 166, which are directed towards one another, are arranged at the coaxially curved regions 164a of the guide plates 164 and such are continued at the substantially linear lateral edges 164b of the guide plates 164 by the therewith merging substantially C-shaped guide channel 14. As will be best recognized by referring again to FIG. 3, the travel wheels 38 of the ball-and-socket joint-link chain 16 are guided at the channel base 40 and at the flanges 44 of the guide channel 14. It is also to be observed that at the curved regions 164a of the guide plates 164 the travel wheels or rolls 38 are guided at the mutually facing legs 166a of the substantially L-shaped guide profiles or profile members 166 owing to the operation of the drive plates 152 which act upon the spacer sleeves 36, as best seen by referring to FIG. 7.

In FIG. 6 there has been shown that a piston-and-cylinder unit or assembly 170 is arranged between a contact or attachment flange 168 disposed at the guide plates 164 and the frame 134. By means of this piston-and-cylinder unit 170 it is possible to pivot the guide plates 164 together with the guide channel 14 about the drive shaft 136, for instance, into the position shown in chain-dot lines and designated by reference characters 14' and 170', respectively. Slide rails or rail members 172 are secured by means of laterally protruding support or carrier elements 171 at the guide profiles 166. The trailing product edges 174 of the printed products 122 slide upon these slide rails or rail members 172. As viewed in the product conveying direction A and parallel to the product infeed conveyor 120 there are stationarily arranged upstream of the product transfer region 130 further slide rails or rail members 176, as best seen by referring to FIG. 6. At these further slide rails 176 there can slide the trailing edges 174 of the printed products 122 of the arriving imbricated stream or shingled formation S of such printed products 122.

The apparatus or arrangement depicted in FIGS. 6 and 7 functions in the following manner:

Gripper elements 12 which arrive in the open gripper position i.e. the open position of the gripper fingers 74 are guided into the product transfer region 130 in synchronism with the trailing product edges 174 of the printed products 122 of the infed imbricated or shingled formation S. The slide shoe 90 of the momentarily effective gripper element 12 travels onto the cam wheel 106a, with the result that the associated clamping finger 74 is moved into the raised open position depicted by reference character 74''' in FIG. 3. In this clamping finger position 74''' of the clamping finger 74 the trailing edge 174 of a printed product 122 comes to bear upon the associated clamping jaw or jaw member 78 which is fixed in relation to the pivotable clamping finger 74. Owing to the action of the actuation element 108 the clamping finger 74 is pivoted or rocked into the raised closed position, as such has been depicted for the clamping finger position 74'' in FIG. 1, and owing to the travel of the slide shoe 90 off of the cam wheel 106a this clamping finger 74 is then moved from the raised clamping finger position 74'' so as to be lowered towards the printed product 122 and to assume the lowered closed clamping finger position 74' depicted in FIG. 1 in phantom or chain-dot lines. As soon as the corresponding gripper element 12 has seized or engaged the associated printed product 122 the leading edge 128 of the printed product 122 is released by the corresponding gripper element 126 of the product infeed conveyor 120 due to the action of the elevation or lifting device 132. The thus taken-over printed product 122 comes to bear upon the leading or downstream located printed product 122 in the outfed imbricated formation S of such printed products 122.

As has been already previously described, it is possible to freely select within a wide range the transport direction of the taken-over printed products 122 by means of the piston-and-cylinder unit or assembly 170. By providing a suitable control for the drive motor 140, it is possible to synchronize without any problem the grippers or gripper elements 12 with the printed products 122 of the arriving imbricated stream S of such printed products 122. In the described apparatus and as depicted in FIGS. 6 and 7 each printed product 122 is engaged by a single gripper or gripper element 12 at the trailing product edge 174. However, it is also possible to provide two ball-and-socket joint-link chains or chain members 16 which are spaced and parallely guided with respect to one another and are synchronously revolvingly driven, so that each printed product 122 is engaged or seized at the lateral edge or marginal regions of the trailing product edge 174 and outfed. It is however, also conceivable to engage the leading product edges 128 of the printed products by means of gripper elements or grippers 12 of the type depicted in FIGS. 1 to 5. The clamping jaw or jaw member 78 of each such gripper element or gripper 12, in this case, would then trail the related shaft or shaft member 62.

It is also possible to arrange at a ball-and-socket joint-link chain 16 or at a different traction element, pairs of grippers or gripper elements 12 which then engage or seize the printed products 122 at the lateral or marginal regions of one of the product edges extending transversely with respect to the product conveying direction F.

While there are shown and described present preferred embodiments of the invention, it is to be distinctly understood that the invention is not limited thereto, but may be otherwise variously embodied and practiced within the scope of the following claims. Accordingly,

What I claim is:

1. A transport apparatus for transporting continuously arriving substantially flat products, such as printed products arriving in an imbricated formation, comprising:

a revolvingly drivable traction element;

means for driving said revolvingly drivable traction element for revolving motion in a predetermined product conveying direction;

a plurality of individually controlled gripper elements arranged in mutually spaced relationship at said revolvingly drivable traction element;

each of said gripper elements comprising a clamping jaw and a clamping finger;

said clamping finger coacting with said clamping jaw of each gripper element for engaging a substantially flat product at a product edge extending transversely with respect to said predetermined product conveying direction;

a shaft member provided for the clamping finger of each gripper element;

bearing means for supporting said shaft member so as to be both independently rotatable and axially displaceable;

said clamping finger extending approximately at right angles from the shaft member of said gripper element;

means for displacing the clamping finger of each gripper element so as to rotate the same from an open position to a closed position;

said clamping finger of each gripper element being directed substantially transversely with respect to said predetermined product conveying direction when said clamping finger assumes said open position;

said clamping finger being directed in said predetermined product conveying direction when said clamping finger of each gripper element assumes said closed position;

a closing spring provided for each gripper element;

said closing spring providing a pre-biasing torsional force to said clamping finger so as to bias said clamping finger toward the open position thereof;

said closing spring of each gripper element having a predetermined compressive force which, in the closed position of the clamping finger, causes said clamping finger to be pressed against said clamping jaw with a predetermined contact force which is sufficient to prevent said pre-biasing force from moving said clamping finger toward said open position, and means for slightly raising said clamping finger from said clamping jaw when in said closed position so as to release said predetermined contact force and such that said pre-biasing force is then adapted to immediately move said clamping finger to said open position.

2. The transport apparatus as defined in claim 1, wherein:

said closing spring of each clamping element has opposed ends;

an overhang member secured at said revolvingly drivable traction element and provided for each gripper element;

one end of the closing spring being secured at the overhang member of the associated gripper element; and the other end of said closing spring being rigidly connected for rotation with said shaft member of the clamping finger of the gripper element.

3. The transport apparatus as defined in claim 1, wherein:

said means for displacing said clamping finger of each gripper element so as to rotate the same from an open position to a closed position comprises:

each shaft member having an end region located remote from said clamping finger thereof;

a slide shoe seated upon said end region of said shaft member;

said slide shoe laterally protruding from said shaft member in the open position of said clamping finger;

a stationary actuation element position to cooperate with said slide shoe; and said laterally protruding slide shoe cooperating with said stationary actuation element in order to pivot said clamping finger into the closed position thereof.

4. The transport apparatus as defined in claim 3, wherein:

said means for slightly raising said clamping finger comprises;

each shaft member having at said end region a shaft end located remote from the clamping finger of the associated gripper element;

a further slide shoe provided at said shaft end of said shaft member;

a stationarily arranged actuation means; and said further slide shoe traveling onto said stationarily arranged actuation means in order to raise said shaft member against the action of the closing spring out of the closed position of the clamping finger.

5. The transport apparatus as defined in claim 4, wherein:

said stationarily arranged actuation means comprises a stationarily arranged cam member.

6. The transport apparatus as defined in claim 1 wherein said clamping jaw of each of said gripper elements includes a cover of friction promoting material.

7. A transport apparatus for transporting continuously arriving substantially flat products, such as printed products arriving in an imbricated formation, comprising:

a revolvingly drivable traction element;

means for driving said revolvingly drivable traction element for revolving motion in a predetermined product conveying direction;

a plurality of individually controlled gripper elements arranged in mutually spaced relationship at said revolvingly drivable traction element;

each of said gripper elements comprising a clamping jaw and a clamping finger;

said clamping finger coacting with said clamping jaw of each gripper element for engaging a substantially flat product at a product edge extending transversely with respect to said predetermined product conveying direction;

a shaft member provided for the clamping finger of each gripper element;

said clamping finger extending approximately at right angles from the shaft member of said gripper element;

means for displacing the clamping finger of each gripper element so as to move between an open position and a closed position;

said clamping finger of each gripper element being directed substantially transversely with respect to said predetermined product conveying direction when said clamping finger assumes said open position;

said clamping finger being directed in said predetermined product conveying direction when said clamping finger of each gripper element assumes said closed position;

a closing spring provided for each gripper element;

said closing spring biasing the clamping finger towards the clamping jaw of the gripper element;

said clamping finger of each gripper element being resiliently pre-biased with a pre-biasing force toward the open position thereof;

said closing spring of each gripper element having a predetermined force which, in the closed position of the clamping finger, is greater than said pre-biasing force;

said closing spring producing said pre-biasing force for resiliently pre-biasing the clamping finger;

said closing spring of each clamping element having opposed ends;

an overhang member secured at said revolvingly drivable traction element and provided for each gripper element;

one end of the closing spring being secured at the overhang member of the associated gripper element;

the other end of the said closing spring being rigidly connected for rotation with said shaft member of the clamping finger of the gripper element;

a profile element provided for the clamping jaw of each gripper element; and means for pivotably mounting said profile element at the overhang member of the associated gripper element for limited pivotable movement about a predetermined pivot axis.

8. The transport apparatus as defined in claim 7, wherein:

said predetermined pivotal axis extends approximately parallel to said predetermined product conveying direction.

9. The transport apparatus as defined in claim 7, further including:

a friction-promoting cover means covering said profile element of each gripper element.

10. The transport apparatus as defined in claim 7, wherein:

each clamping finger has a clamping finger portion situated to coact with the clamping jaw of the gripper element; and said clamping finger portion having a substantially concave configuration with respect to said clamping jaw.

* * * * *

UNITED STATES PATENT AND TRADEMARK OFFICE

CERTIFICATE OF CORRECTION

PATENT NO. : 4,982,944

DATED : January 8, 1991

INVENTOR(S) : Jürg Eberle

It is certified that error appears in the above-identified patent and that said Letters Patent is hereby corrected as shown below:

Column 5, line 13, "240" should be -- 24 --.

Column 5, line 40, after "particularly", please insert -- designated axis of rotation of which is oriented --.

Signed and Sealed this

Twenty-fourth Day of August, 1993

Bruce Lehman

*Attest:*

BRUCE LEHMAN

*Attesting Officer*

*Commissioner of Patents and Trademarks*